US009167355B2

(12) United States Patent
Buehlmann et al.

(10) Patent No.: US 9,167,355 B2
(45) Date of Patent: Oct. 20, 2015

(54) SYSTEM AND METHOD FOR IN-SITU EVALUATION OF AN IMPLANTABLE HEARING INSTRUMENT ACTUATOR

(75) Inventors: Felix Buehlmann, Lausanne (CH); Louisa Busca Grisoni, Bonvillars (CH)

(73) Assignee: Advanced Bionics AG, Staefa (CH)

( * ) Notice: Subject to any disclaimer, the term of this patent is extended or adjusted under 35 U.S.C. 154(b) by 151 days.

(21) Appl. No.: 14/122,242

(22) PCT Filed: May 27, 2011

(86) PCT No.: PCT/EP2011/058744

§ 371 (c)(1),
(2), (4) Date: Nov. 25, 2013

(87) PCT Pub. No.: WO2012/163388

PCT Pub. Date: Dec. 6, 2012

(65) Prior Publication Data

US 2014/0086424 A1 Mar. 27, 2014

(51) Int. Cl.
*H04R 29/00* (2006.01)
*H04R 25/00* (2006.01)

(52) U.S. Cl.
CPC ..... *H04R 25/30* (2013.01); *H04R 25/606* (2013.01); *H04R 2225/67* (2013.01)

(58) Field of Classification Search
CPC ... H04R 25/30; H04R 25/606; H04R 2225/67
USPC ..... 381/60
See application file for complete search history.

(56) References Cited

U.S. PATENT DOCUMENTS 5,776,179 A 7/1998 Ren et al.
5,999,856 A * 12/1999 Kennedy ..... 607/57
6,342,035 B1 1/2002 Kroll et al.
6,636,768 B1 10/2003 Harrison

FOREIGN PATENT DOCUMENTS

WO WO 2006/062625 6/2006

OTHER PUBLICATIONS

International Search Report and Written Opinion received in International Application No. PCT/EP2011/058744 dated Feb. 20, 2012.

* cited by examiner

*Primary Examiner* — Paul S Kim
(74) *Attorney, Agent, or Firm* — ALG Intellectual Property, LLC

(57) ABSTRACT

A system for in-situ evaluation of the performance of an actuator of a hearing instrument to be implanted in a middle ear cavity of a patient and to be mechanically coupled to an ossicle or to the cochlea includes: a reference output transducer assembly for generating sound waves in the middle ear cavity, means for providing test audio signals as input to the actuator and to the reference transducer assembly, a microphone assembly for being inserted at least in part into the middle ear cavity for picking up sound waves in the middle ear cavity generated by vibrations of the actuator and by the reference output transducer assembly according to the test audio signals and for providing for an output signal corresponding to the picked-up sound waves, and means for analyzing the output signals of the microphone assembly in order to evaluate the actuator performance.

17 Claims, 4 Drawing Sheets

SYSTEM AND METHOD FOR IN-SITU EVALUATION OF AN IMPLANTABLE HEARING INSTRUMENT ACTUATOR

The invention relates to a method and system for in-situ evaluation of the performance of an actuator of a hearing instrument, which actuator is implanted in the middle ear cavity of a patient and is mechanically coupled to an ossicle or to the cochlea.

Fully or partially implantable hearing instrument comprise an implantable actuator which typically is implanted in the middle ear cavity of the patient and is mechanically coupled to an ossicle or to the cochlea, for example, via an artificial incus. The performance of the actuator, and in particular the coupling of the actuator to the coupling site, is crucial for the performance of the hearing instrument. Since replacement of an actuator damaged during implantation or correction of the actuator coupling after closing of the wound requires a new surgery, it is important that the actuator performance can be evaluated in-situ during surgery.

A known method for such in-situ evaluation of actuator performance uses a laser Doppler vibrometer (LDV) device, wherein the vibrations caused by the implanted actuator are sensed by a laser beam which impinges through the ear canal and which is reflected or scattered at a vibrating component of the patient's ear or of the actuator. The collected data is analyzed in order to evaluate the actuator performance. However, such LDV devices are costly, bulky and complex equipment which is difficult to set up and operate.

Another in-situ evaluation method, which is described for example in U.S. Pat. No. 6,663,575 B1 , is to measure the actuator impedance by measuring current and voltage on the transducer and send it by back-telemetry to an external device for analysis. However, such method is complex and costly and may involve problems concerning reliability.

Still another known way to obtain information on actuator performance is to place a microphone in the ear canal in order to receive feedback from a middle ear implant through the tympanic membrane. Examples of such method are described in EP 1 251 810 B1, U.S. 2010/0246841 A1 and U.S. 2006/0247488 A1 . However, such method may not be usable for testing actuator performance during surgery when the tympanic membrane is removed. Even if the tympanic membrane remains in place, the measurement can be altered for patients with a partially or fully impaired ossicular chain.

US 2009/0182521 A1 relates to a method for determining the magnitude and phase calibration of accelerometers, wherein the accelerometer to be measured is mounted in a shaker mechanism together with another accelerometer as a reference sensor. US 2011/0000275 A1 relates to a similar accelerometer test method using a reference transducer.

It is an object of the invention to provide for a system and a method for in-situ evaluation of the performance of a hearing instrument actuator implanted in the middle ear cavity, wherein the system should be relatively inexpensive, small and easy to use, while nevertheless providing for relatively accurate evaluation of the actuator performance.

According to the invention, these objects are achieved by a system as defined in claim 1 and a method as defined in claim 12, respectively.

The invention is beneficial in that, by using a reference output transducer assembly for generating sound waves in the middle ear cavity which are picked up, together with the sound waves generated by vibrations of the actuator, by a microphone assembly in the middle ear cavity, an inexpensive, easy to set up and operate and nevertheless relatively reliable intra-operative actuator performance test system and method is provided. In particular, by using the reference output transducer assembly, the impact of the acoustic surroundings of the actuator (formed by the middle ear air space, the ear canal and the masteodectomy opening) can be eliminated, at least to some extent, by taking into account, in addition to the sound generated by the actuator, also the sound generated by the reference transducer assembly, so that the contribution of the actuator can be separated from the contributions of the specific acoustic environment of the actuator.

Preferred embodiments of the invention are defined in the dependent claims.

Hereinafter, examples of the invention will be illustrated by reference to the attached drawings, wherein.

Figure 1:
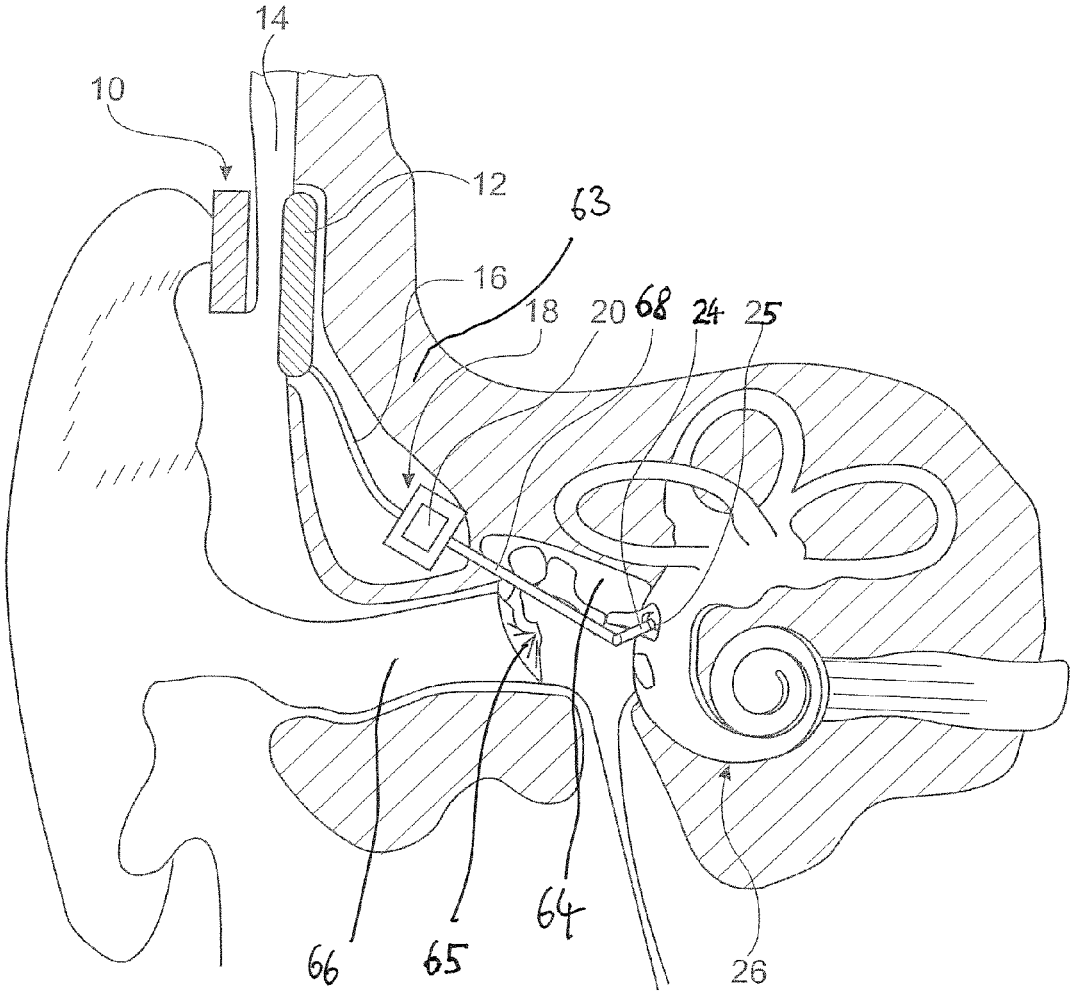
FIG. 1 is a schematic cross-sectional view of an example of a hearing instrument, which may be evaluated by using the present invention, after implantation.

FIG. 1 shows a cross-sectional view of the mastoid region, the middle ear and the inner ear of a patient after implantation of an example of a hearing instrument which can be evaluated by a system according to the invention, wherein the hearing instrument is shown only schematically. The hearing instrument comprises an external unit 10 which is worn outside the patient's body at the patient's head, typically close to the ear, and an implantable unit 12 which is implanted under the patient's skin 14, usually in an artificial cavity created in the user's mastoid. The implantable unit 12 is connected, via a cable assembly 16, to a stimulation assembly 18 comprising an electromechanical actuator 20 for stimulating the cochlea 26 via a lever element 70 which forms an artificial incus to which a stapes prosthesis 24 mounted at the stapes footplate 25 is crimped to.

The external unit 10 is fixed at the patient's skin 14 in a position opposite to the implantable unit 12, for example, by magnetic forces created between at least one fixation magnet provided in the external unit 10 and at least one co-operating fixation magnet provided in the implantable unit 12 (the magnets are not shown in FIG. 1).

Figure 2:
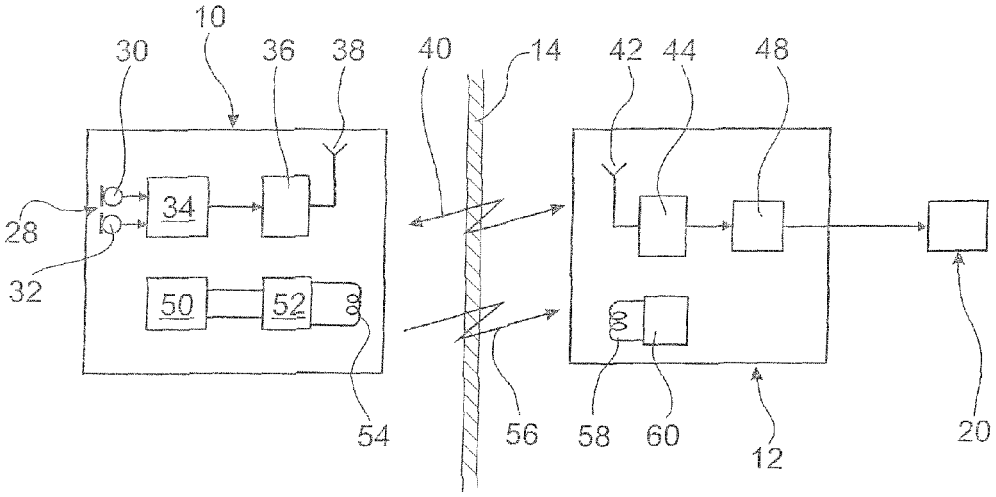
FIG. 2 is a block diagram of the hearing instrument of FIG. 1.

An example of a block diagram of the system of FIG. 1 is shown in FIG. 2. The external unit 10 includes a microphone arrangement 28, which typically comprises at least two spaced-apart microphones 30 and 32 for capturing audio signals from ambient sound, which audio signals are supplied to an audio signal processing unit 34, wherein they undergo, for example, acoustic beam forming. The processed audio signals are supplied to a transmission unit 36 connected to a transmission antenna 38 in order to enable transcutaneous transmission of the processed audio signals via an inductive link 40 to the implantable unit 12 which comprises a receiver antenna 42 connected to a receiver unit 44 for receiving the transmitted audio signals. The received audio signals are supplied to a driver unit 48 which drives the actuator 20.

The external unit 10 also comprises a power supply 50 which may be a replaceable or rechargeable battery, a power transmission unit 52 and a power transmission antenna 54 for transmitting power to the implantable unit 12 via a wireless power link 56. The implantable unit 12 comprises a power receiving antenna 58 and a power receiving unit 60 for powering the implanted electronic components with power received via the power link 56.

Preferably, the audio signal antennas 38, 42 are separated from the power antennas 54, 58 in order to optimize both the audio signal link 40 and the power link 56. However, if a particularly simple design is desired, the antennas 38 and 54 and the antennas 42 and 58 could be physically formed by a single antenna, respectively.

Figure 3:
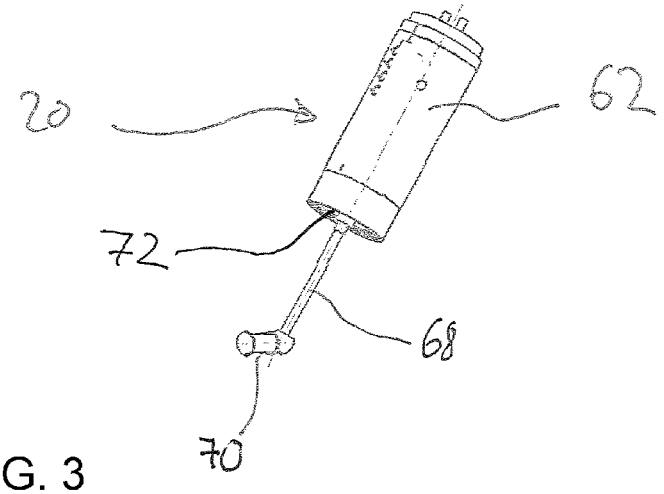
FIG. 3 is a perspective view of an actuator to be used in the hearing instrument of FIG. 1.

An example of the actuator 20 is shown in FIG. 3, wherein a housing 62, a coupling rod 68 carrying an artificial incus 70 at its free end and a membrane 72 closing one end of the cylindrical housing 62 are shown. The coupling rod 68 passes through a central opening of the membrane 72 and is fixed at the membrane 72. The coupling rod 68 is driven to a reciprocating axial movement by an electromagnetic motor contained within the housing 62 (not shown), whereby the membrane 72 is vibrated when the coupling rod 68 is driven. An example of such actuator 20 is shown in detail in WO 2006/058368 A1.

Figure 4:
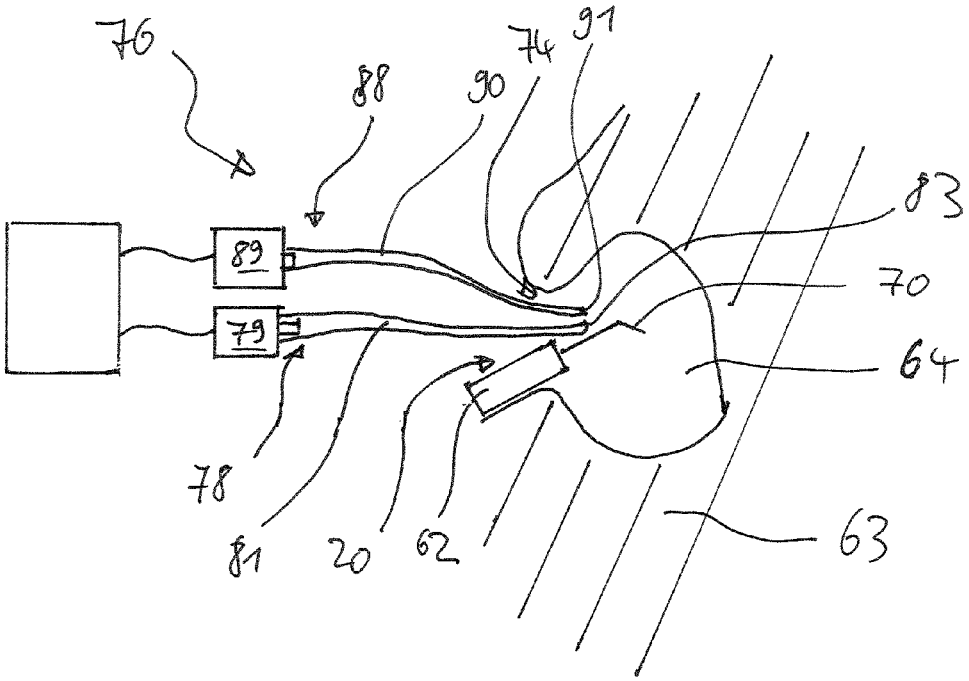
FIG. 4 is a schematic cross-sectional view of the middle ear cavity of a patient during implantation of an actuator, with the actuator performance being evaluated by a system according to the invention.

FIG. 4 is a schematic view of a patient's ear during implantation of the actuator 20 of the hearing instrument. For implanting the actuator 20, an artificial cavity 74 is drilled into the temporal bone 63 in order to provide access to a middle ear cavity 64. For example, the artificial cavity 74 may have the shape of a tunnel extending essentially parallel to the ear canal 66. In addition, the ear canal 66 is prepared by surgery for providing an additional access to the middle ear cavity 64, wherein the tympanic membrane 65 is opened. After having been inserted into the artificial cavity 74, the actuator 20 is fixed at the temporal bone 63 via a fixation system (not shown). A stapes prosthesis 24 is inserted through an artificial hole in the stapes footplate 25 into the cochlear 26 and is crimped to the artificial incus 70.

Figure 5:
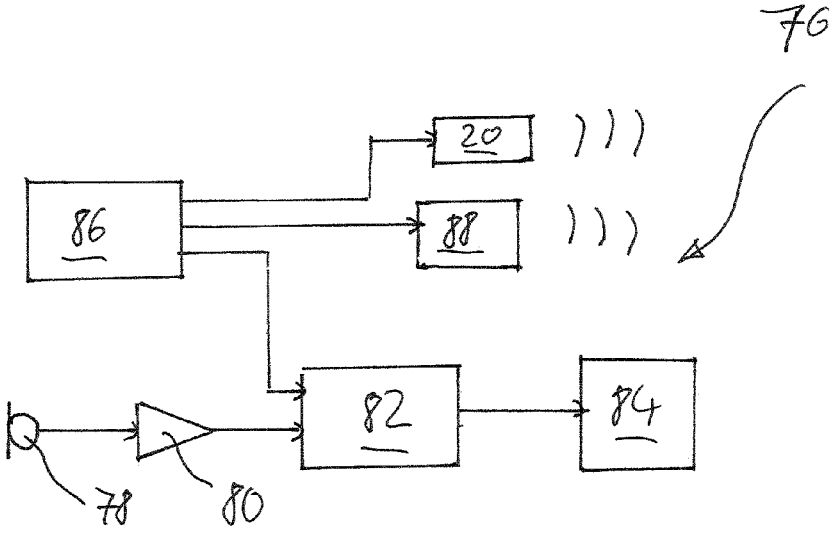
FIG. 5 is a block diagram of an example of an evaluation system according to the invention.

An example of an evaluation system 76 is shown in FIGS. 4 and 5, which comprises a microphone assembly 78, an amplifier unit 80 for amplifying the audio signals captured by the microphone assembly 78, a signal analyzing unit 82 for analyzing the audio signals captured by the microphone assembly 78, a display unit 84 for displaying the result of the analysis performed in the analyzing unit 82 to the surgeon, a test audio signal generator unit 86 and a reference output transducer assembly 88 which is supplied with test audio signals from the signal generator unit 86. Also the actuator 20 may be supplied with test audio signals from the signal generating unit 86, usually via the external unit 10 and the implantable unit 12. Alternatively, the test audio signals for the actuator 20 may be generated in the external unit.

As shown in FIG. 4, the microphone assembly 78 may comprise a microphone 79 and a sound tube 81 extending from the microphone 79 and having an open end 83 which is inserted into the middle ear cavity 64. The reference transducer assembly 88 may comprise a loudspeaker 89 and a sound tube 90 extending from the loudspeaker 89 and having an open end 91 which is inserted into the middle ear cavity 64.

Figure 6:
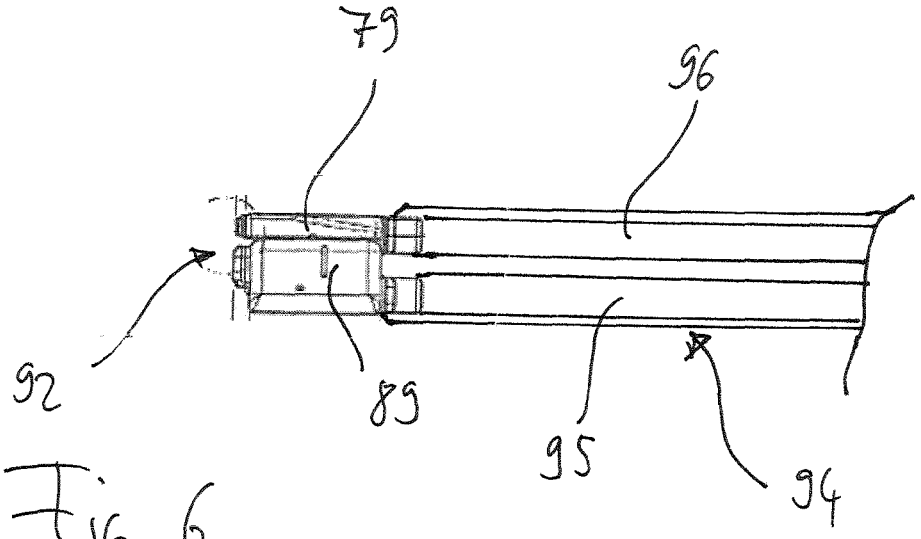
FIG. 6 is a schematic view of an alternative embodiment of the microphone assembly and the reference transducer assembly of a system according to the invention.

In the example shown in FIG. 4, the microphone assembly 78 and the reference transducer assembly 88 are separate from each other. However, according to an alternative embodiment shown in FIG. 6, the microphone assembly 78 and the reference transducer assembly 88 may have a common housing to form a combo setup 92, wherein a common tube assembly 94 may be provided, wherein the sound tube of the microphone assembly 78 and the sound tube 90 of the reference transducer assembly are formed as ducts 96 and 95, respectively.

According to a further but less preferred alternative embodiment the reference transducer assembly may comprise the same type of transducer as the actuator 20, rather than employing a loudspeaker 89.

The test signals may be supplied to the actuator 20 and the reference transducer assembly 88 subsequently or simultaneously. In any case, the test signals have to be supplied in such a manner that the sound waves resulting from the actuator 20 can be distinguished from waves resulting from the reference transducer assembly 88 by analyzing the audio signals captured by the microphone assembly 78. Such distinction may be achieved by supplying, as already mentioned, the test signals in a subsequent manner, so that at a time only one of the actuator 20 and the reference transducer assembly 88 generates sound waves. In case that the test signals are supplied simultaneously, the test signals supplied to the actuator 20 and the test signals supplied to the reference transducer 88 may differ, for example, spectrally, so that they can be distinguished in the frequency domain.

Various test signals can be used, such as sine signals, sine sweep (chirp) signals, multisine signals, white noise signals, etc. In order to be able to distinguish simultaneously applied test signals, the test signals may be wide noises with zero co-variants or two multisine signals with slightly different frequencies, for example one test signal having frequencies at 100 Hz, 200 Hz, 300 Hz, etc. and the other test signal having frequencies at 101 Hz, 201 Hz, 301 Hz, etc.

The sound waves generated by the test signals supplied to the actuator 20 and the reference transducer assembly 88 are picked up, by the microphone assembly 78, as audio signals which are amplified in the unit 80 and are analyzed in the unit 82, wherein the audio signals resulting from the vibration of the actuator 20, in particular the membrane 72, are compared to the audio signals resulting from the sound emitted by the reference transducer 88 in order to compensate for the impact of the acoustic surroundings of the actuator 20. The measured pressure $P_1$ from the actuator 20 to be tested and its volume displacement $Q_1$ are related by $P_1=Z_{ac}\times Q_1$, wherein $Z_{ac}$ is the impedance of the acoustic environment of the actuator 20, which is unknown and may be very complex. Likewise, the measured pressure $P_2$ from the reference transducer assembly 88 and its volume displacement $Q_2$ are related by $P_2=Z_{ac}\times Q_2$. as $Q_2$ is known and $P_2$ is measured, the impedance of the acoustic environment $Z_{ac}$ can be determined from these two equations, and with the measurement of $P_1$ the volume displacement $Q_1$ of the actuator 20 can be determined.

Figure 7:
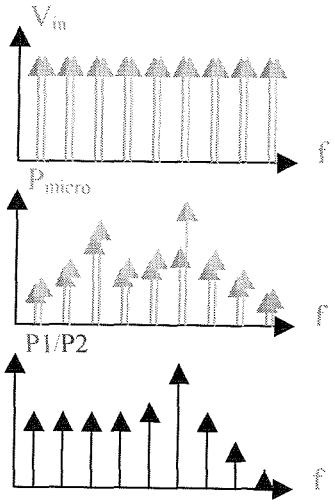
FIG. 7 is a schematic spectral representation of audio signals used and obtained when using an evaluation system according to the invention.

A schematic example of the respective audio signals in the frequency domain is shown in FIG. 7. Multi-sinus test signals $V_{in}$ which are slightly shifted in frequency with regard to each other in order to be distinguishable are supplied to the actuator 20 and the reference transducer assembly 88 (see top of FIG. 7). The resulting audio signals $P_{micro}$, as measured by the microphone assembly 78, are shown in the frequency domain in the middle of FIG. 7. The resulting ratio of the measured audio signals $P_1$ resulting from the actuator 20, as divided by the measured audio signal $P_2$ resulting from the reference transducer assembly 88, is shown at the bottom of FIG. 7 in the frequency domain. The result of the analysis performed in the analyzing unit 82 is displayed on the display unit 84 to the surgeon.

A first measurement already may be performed before the artificial incus 70 is connected to the stapes prosthesis 24 in order to ensure that the actuator 20 has not been damaged during implantation. A second measurement may be performed after the artificial incus 70 has been coupled to the stapes prosthesis 24.

Preferably, the microphone assembly 78 is able to pick up sound waves over the entire frequency range of the actuator 20, which typically extends up to about 10 kHz.

It is to be understood that the evaluation system and method of the present invention can be applied not only to the type of hearing instruments described so far. Rather, the present invention is useful for any type of implantable actuator which is located in the middle ear cavity and which is mechanically coupled to an ossicle or to the cochlear.

It also to be noted that, in case that the test audio signal is supplied to the actuator 20 the via the implantable unit 12, the present invention also to allows to check whether the implantable unit 12 works properly, since any malfunction of the implantable unit 12 then translates into a resulting loss of performance of the actuator 20 which, in turn, can be detected by the present invention.

In case that the microphone assembly 78 and the reference transducer assembly 88 are so small that they can be inserted into the middle ear cavity 64 during the measurements, the sound tubes 81 and 90 may be omitted.

The invention claimed is:

1. A system for in-situ evaluation of the performance of an actuator of a hearing instrument to be implanted in a middle ear cavity of a patient and to be mechanically coupled to an ossicle or to the cochlea, comprising:

a reference output transducer assembly for being inserted at least in part into the middle ear cavity for generating sound waves in the middle ear cavity, means for providing test audio signals as input to the actuator and to the reference transducer assembly, a microphone assembly for being inserted at least in part into the middle ear cavity for picking up sound waves in the middle ear cavity generated by vibrations of the actuator and by the reference output transducer assembly according to the test audio signals and for providing for an output signal corresponding to the picked-up sound waves, and means for analyzing the output signals of the microphone assembly in order to evaluate the actuator performance.

2. The system of claim 1, wherein the reference transducer assembly comprises a loudspeaker.

3. The system of claim 2, wherein the reference transducer assembly comprises a sound tube extending from the loudspeaker and having an open end to be inserted into the middle ear cavity.

4. The system of claim 3, wherein the microphone assembly comprises a sound tube extending from a microphone and having an open end to be inserted into the middle ear cavity.

5. The system of claim 4, wherein the sound tube of the microphone assembly and the sound tube of the reference transducer assembly are formed as ducts of a common tube assembly.

6. The system of claim 1, wherein the microphone assembly and the reference transducer assembly have a common housing to form a combo setup.

7. The system of claim 1, wherein the reference transducer assembly is of the same type as the actuator.

8. The system of claim 1, wherein the actuator comprises a membrane connected to a coupling rod.

9. The system of claim 1, wherein the microphone assembly is designed to pick-up sound waves over the entire frequency range of the actuator.

10. The system of one of claim 1, wherein the analyzing means are adapted for analysis in the frequency domain.

11. The system of claim 1, further comprising means for displaying a result of the analysis of the output signals of the microphone assembly to a surgeon.

12. A method of in-situ evaluation of the performance of an actuator of a hearing instrument, comprising creating an access to a middle ear cavity of a patient;

implanting the actuator in the middle ear cavity and mechanically coupling the actuator to an ossicle or to the cochlea;

placing a microphone assembly and a reference output transducer assembly at least in part into the middle ear cavity;

generating a vibrational output of the actuator and of the reference output transducer assembly by supplying test audio signals to the actuator and of the reference output transducer assembly;

measuring the vibrational output of the actuator and of the reference output transducer assembly by picking up sound waves generated by vibrational output of the actuator and the reference output transducer assembly via the microphone assembly; and evaluating the actuator performance based of the output signals of the microphone assembly corresponding to the picked-up sound waves.

13. The method of claim 12, wherein the actuator and the reference output transducer assembly are simultaneously supplied with the test audio signals, and wherein the test audio signals supplied to the actuator and the reference output transducer assembly are different.

14. The method of claim 13, wherein the test signals supplied to the actuator and the reference output transducer assembly differ spectrally.

15. The method of claim 14, wherein the test signals supplied to the actuator and the reference output transducer assembly are multisine signals.

16. The method of claim 12, wherein the actuator and the reference output transducer assembly are subsequently supplied with the test audio signals.

17. The method of claim 12, wherein the actuator comprises an artificial incus to which a stapes prosthesis is crimped.

* * * * *